US007869901B2

(12) United States Patent
Johnson et al.

(10) Patent No.: US 7,869,901 B2
(45) **Date of Patent: *Jan. 11, 2011**

(54) CONTROL SYSTEMS AND METHODS FOR A WATER DISPENSER ASSEMBLY

(75) Inventors: Eric Scott Johnson, Louisville, KY (US); John Kenneth Hooker, Louisville, KY (US); Anil Kumar Tummala, Hyderabad (IN); Eric Paez, Louisville, KY (US)

(73) Assignee: General Electric Company, Schenectady, NY (US)

( * ) Notice: Subject to any disclaimer, the term of this patent is extended or adjusted under 35 U.S.C. 154(b) by 900 days.

This patent is subject to a terminal disclaimer.

(21) Appl. No.: 11/495,976

(22) Filed: Jul. 27, 2006

(65) Prior Publication Data

US 2007/0093936 A1 Apr. 26, 2007

Related U.S. Application Data

(63) Continuation-in-part of application No. 11/258,657, filed on Oct. 26, 2005.

(51) Int. Cl.
*G06F 17/00* (2006.01)

(52) U.S. Cl. ..... 700/240; 700/232; 700/236; 222/146.6; 62/89

(58) Field of Classification Search ..... 700/231–244
See application file for complete search history.

(56) References Cited

U.S. PATENT DOCUMENTS 3,765,569 A 10/1973 Rimini
4,150,767 A 4/1979 Pitches et al.
4,191,025 A 3/1980 Webb
4,433,701 A 2/1984 Cox et al.
4,487,333 A * 12/1984 Pounder et al. ..... 222/54
4,520,950 A 6/1985 Jeans
4,793,513 A 12/1988 Verheijen
4,885,943 A 12/1989 Tootell et al.
5,038,971 A * 8/1991 Gayer et al. ..... 222/1
5,124,934 A 6/1992 Kawamoto et al.
5,135,645 A 8/1992 Sklenak et al.
5,291,004 A 3/1994 Frank et al.
5,419,150 A 5/1995 Kaiser et al.
5,495,725 A 3/1996 Middlemiss
5,502,978 A 4/1996 Field
5,542,450 A 8/1996 King et al.
5,551,598 A 9/1996 Cutsinger
5,737,932 A 4/1998 Lee
5,819,547 A 10/1998 Oh (Continued)

*Primary Examiner*—Gene Crawford
*Assistant Examiner*—Michael K Collins
(74) *Attorney, Agent, or Firm*—George L. Rideout, Esq.; Armstrong Teasdale LLP

(57) ABSTRACT

An appliance includes a dispenser having a water valve for controlling a flow of water through the dispenser and a flowmeter for measuring the amount of water dispensed through the dispenser, and a controller operatively coupled to the water valve and the flowmeter. The controller is configured to receive an input relating to a target volume of water, adjust the target volume for a volume error correction to obtain an adjusted target volume, wherein the volume error correction is based on a flow rate, open the water valve, determine a total volume dispensed using the flowmeter, and close the water valve when the total volume dispensed equals the adjusted target volume.

20 Claims, 7 Drawing Sheets

U.S. PATENT DOCUMENTS

| | | | | |
|---|---|---|---|---|
| 5,911,744 | A | 6/1999 | Kawaguchi | |
| 6,041,607 | A | 3/2000 | Kim | |
| 6,093,312 | A | 7/2000 | Boulter | |
| 6,354,341 | B1 * | 3/2002 | Saveliev et al. | 141/94 |
| 6,354,342 | B1 | 3/2002 | Gagliano | |
| 6,550,642 | B2 | 4/2003 | Newman et al. | |
| 6,912,870 | B2 | 7/2005 | Gnadinger | |
| 6,952,937 | B2 | 10/2005 | Choi et al. | |
| 6,955,056 | B1 | 10/2005 | An et al. | |
| 7,475,555 | B2 * | 1/2009 | Janardhanam et al. | 62/89 |
| 2003/0200870 | A1 * | 10/2003 | Cocchi et al. | 99/275 |
| 2005/0038557 | A1 * | 2/2005 | Friel et al. | 700/233 |
| 2006/0196212 | A1 | 9/2006 | Jenkins, Jr. et al. | |

* cited by examiner

CONTROL SYSTEMS AND METHODS FOR A WATER DISPENSER ASSEMBLY

CROSS REFERENCE TO RELATED APPLICATIONS

This application is a continuation-in-part and claims priority to U.S. patent application Ser. No. 11/258,657 filed Oct. 26, 2005 for "WATER DISPENSER ASSEMBLY AND METHOD OF ASSEMBLING SAME," which is hereby incorporated by reference herein in its entirety.

BACKGROUND OF THE INVENTION

This invention relates generally to water dispenser assemblies, and more specifically, to control systems and methods for appliances having water dispenser assemblies.

Appliances, such as refrigerators, generally include water dispenser assemblies. Known refrigerators include a housing defining a cabinet which is separated into a fresh food storage compartment and a freezer compartment, with a fresh food storage door and a freezer door rotatably hinged to an edge of the housing to provide access to the fresh food storage compartment and freezer compartment. The refrigerator also includes an ice maker received within the freezer compartment to produce ice pieces, a through-the-door dispenser configured to deliver the ice pieces outside the cabinet for a user's access, and a water supply arranged in communication with the ice maker to supply water therein.

However, known refrigerators do not provide a user with accurate control of water dispensing. Additionally, known refrigerators do not provide a user with selective modes of water dispensing to the ice maker. For example, the user sometimes desires to control the size of ice pieces produced by the ice maker. In addition, known refrigerators also do not provide the user with outside refrigerator access to a predetermined amount of water.

BRIEF DESCRIPTION OF THE INVENTION

In one aspect, an appliance is provided including a dispenser having a water valve for controlling a flow of water through the dispenser and a flowmeter for measuring the amount of water dispensed through the dispenser, and a controller operatively coupled to the water valve and the flowmeter. The controller is configured to receive an input relating to a target volume of water, adjust the target volume for a volume error correction to obtain an adjusted target volume, wherein the volume error correction is based on a flow rate, open the water valve, determine a total volume dispensed using the flowmeter, and close the water valve when the total volume dispensed equals the adjusted target volume.

In another aspect, a method of controlling a water valve for a water dispensing system having a controller communicating with the water valve and a flowmeter is provided. The method includes receiving a target volume at the controller from a user interface, adjusting the target volume for a volume error correction to obtain an adjusted target volume, wherein the volume error correction is based on a flow rate, opening the water valve, measuring the volume using the flowmeter to determine a total volume, and closing the water valve when the total volume equals the adjusted target volume.

In a further aspect, a computer program embodied on a computer readable medium for controlling a water valve for a water dispensing system having a controller communicating with the water valve and a flowmeter is provided. The program includes a code segment that receives an input relating to a target volume of water, a code segment that adjusts the target volume for a volume error correction to obtain an adjusted target volume, wherein the volume error correction is based on a flow rate, a code segment that opens the water valve, a code segment that determines a total volume dispensed using inputs from the flowmeter, and a code segment that closes the water valve when the total volume dispensed equals the adjusted target volume.

DETAILED DESCRIPTION OF THE INVENTION

Figure 1:
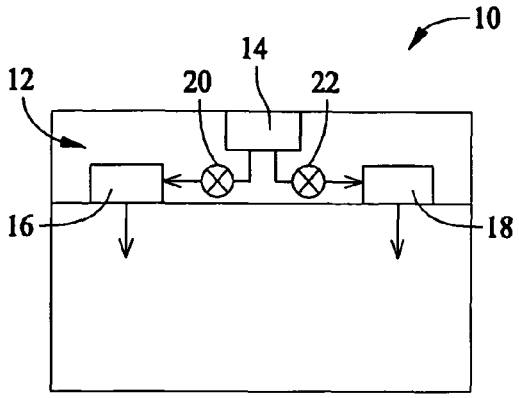
FIG. 1 is a schematic view of a water dispenser assembly for an appliance according to an exemplary embodiment of the present invention.

FIG. 1 is a schematic view of an appliance 10 having a water dispenser assembly 12. Appliance 10 includes known household or commercial grade appliances having a need for water dispenser assembly 12 such as, but not limited to, a refrigerator, a laundry appliance such as a washing machine, a dishwashing appliance, a water treatment appliance, a water dispensing appliance such as a countertop mounted water dispenser for delivering filtered water or hot water near a sink, and the like.

Water dispenser assembly 12 is coupled to appliance 10 for delivering and controlling an amount of water delivered to or from appliance 10. In an exemplary embodiment, water dispenser assembly 12 is programmable or variably selectable to deliver a predetermined amount of water. Water dispenser assembly 12 includes an inlet 14 coupled in flow communication with a plumbing supply line (not shown). Water dispenser assembly 12 also includes at least one outlet, such as first outlet 16 and second outlet 18. Valves 20 and 22 control the flow of water to outlets 16 and 18, respectively. In one embodiment, such as with the refrigerator or the water dispensing appliance, water is delivered to the user via outlets 16 and/or 18. In another embodiment, such as with the laundry appliance or the dishwashing appliance, water is delivered into the cabinet of the appliance via outlets 16 and/or 18.

Figure 2:
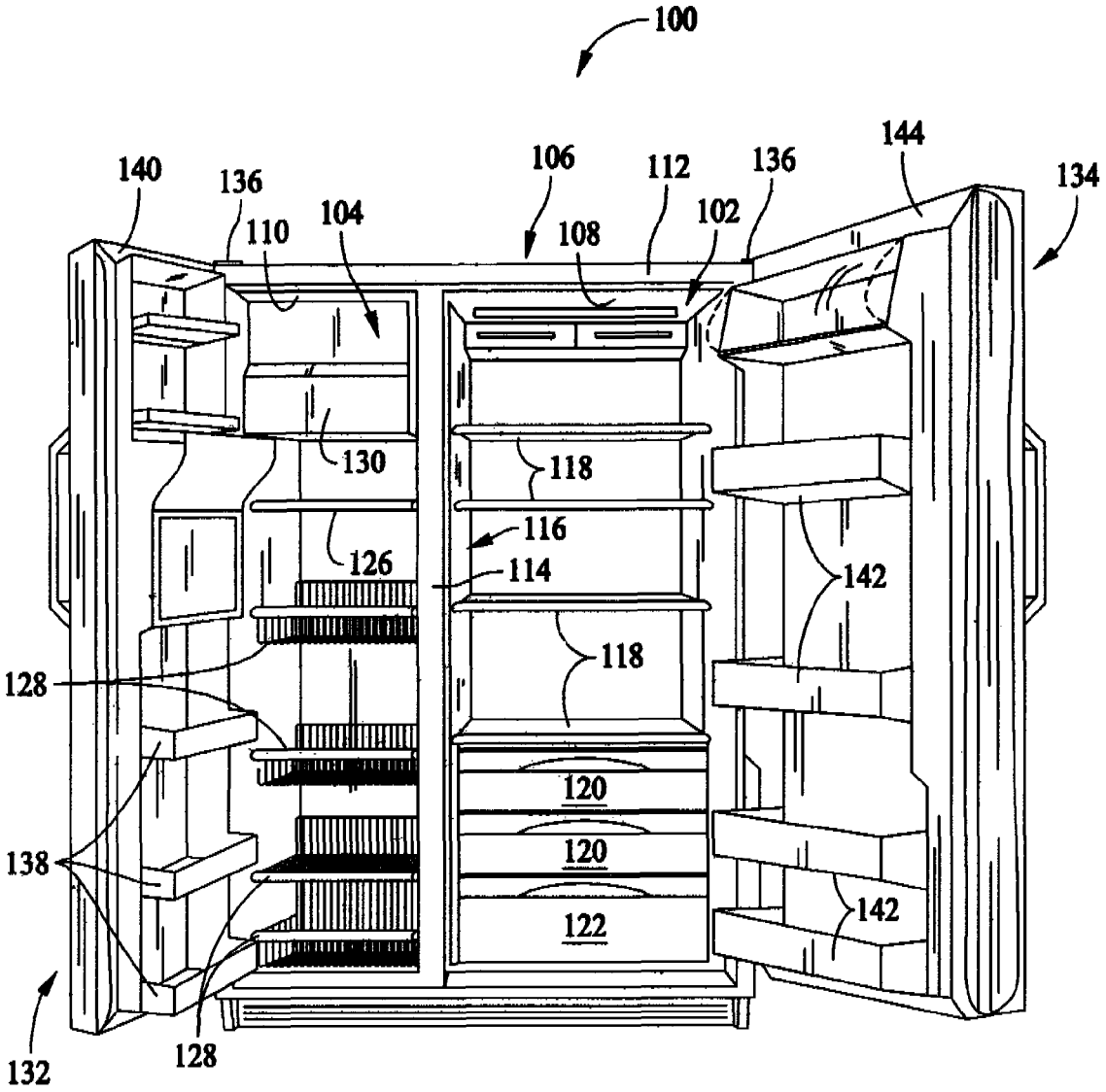
FIG. 2 illustrates a side-by-side refrigerator.

FIG. 2 illustrates an exemplary refrigerator 100. While the apparatus is described herein in the context of a specific refrigerator 100, it is contemplated that the herein described methods and apparatus may be practiced in other types of refrigerators. Therefore, as the benefits of the herein described methods and apparatus accrue generally to ice maker controls in a variety of refrigeration appliances and machines, the description herein is for exemplary purposes only and is not intended to limit practice of the invention to a particular refrigeration appliance or machine, such as refrigerator 100.

Refrigerator 100 includes a fresh food storage compartment 102 and freezer storage compartment 104. Freezer compartment 104 and fresh food compartment 102 are arranged side-by-side, however, the benefits of the herein described methods and apparatus accrue to other configurations such as, for example, top and bottom mount refrigerator-freezers. Refrigerator 100 includes an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. Mullion 114 also, in one embodiment, is formed of an extruded ABS material. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food compartment 102 to support items being stored therein. A bottom drawer or pan 122 is positioned within compartment 102. A shelf 126 and wire baskets 128 are also provided in freezer compartment 104. In addition, an ice maker 130 is provided in freezer compartment 104. Ice maker 130 is supplied with water by a dispenser assembly, such as, for example, water dispenser assembly 12 (shown in FIG. 1)

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 2, and a closed position (shown in FIG. 3) closing the associated storage compartment. Freezer door 132 includes a plurality of storage shelves 138 and a sealing gasket 140, and fresh food door 134 also includes a plurality of storage shelves 142 and a sealing gasket 144.

Figure 3:
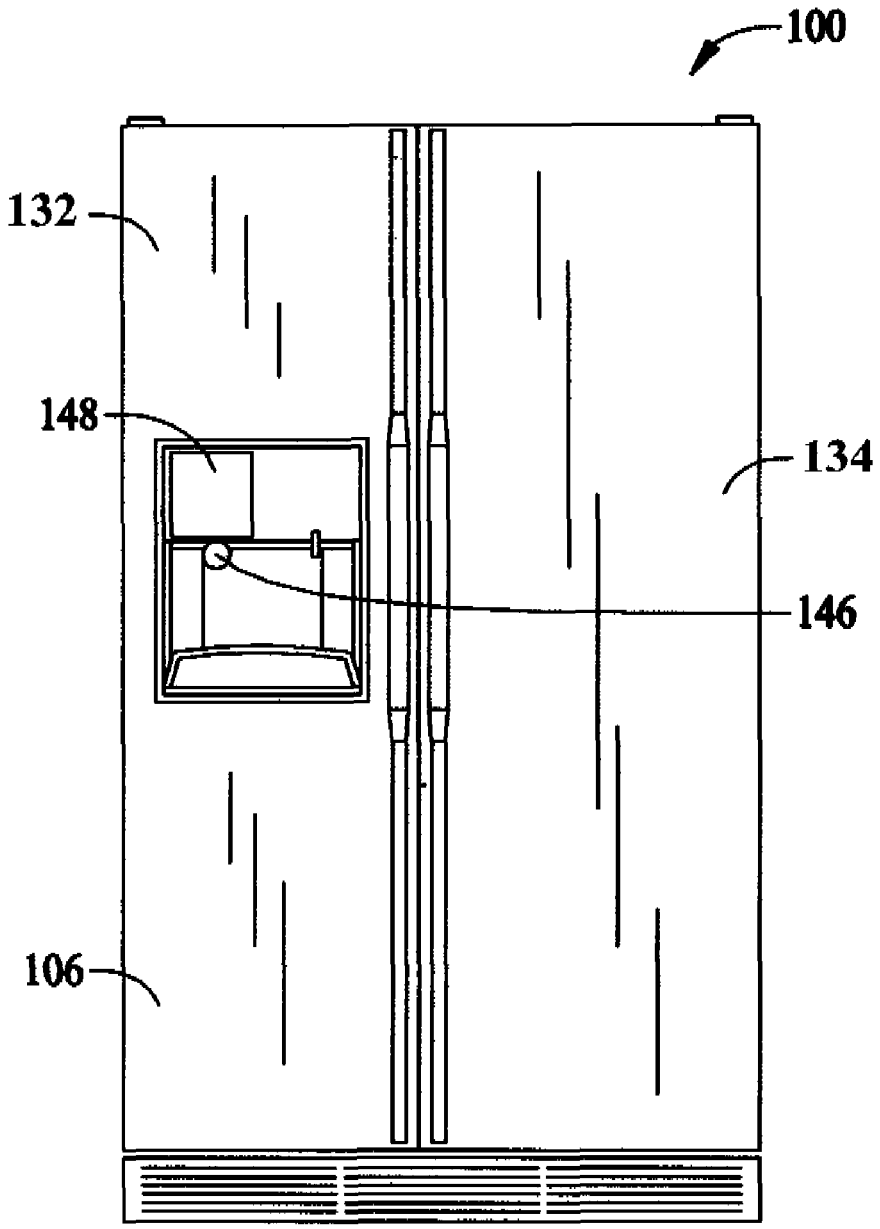
FIG. 3 is front view of the refrigerator of FIG. 2.

FIG. 3 is a front view of refrigerator 100 with doors 132 and 134 in a closed position. Freezer door 132 includes a through the door dispenser 146, and a user interface 148. Dispenser 146 is supplied water by a dispenser assembly, such as, for example, water dispenser assembly 12 (shown in FIG. 1). Additionally, dispenser 146 is supplied ice by from ice maker 130 via a chute (not shown). In the exemplary embodiment, user interface 148 includes a display having touch screen capabilities. In alternative embodiments, user interface 148 includes a display and a separate input board with tactile buttons for a user to select various inputs. In the exemplary embodiment, refrigerator 100 includes a container sensor 149 proximate dispenser 146. Container sensor 149 senses the presence of a container, such as a cup, glass, bowl, or other container, proximate dispenser 146 such that water or ice is delivered to the container. The operation of dispenser 146 is restricted if a container is not sensed by container sensor 149. In the exemplary embodiment, container sensor 149 is an optical sensor.

In use, and as explained in greater detail below, a user enters an input, such as, for example, a desired amount of water or a desired ice cube size, using interface 148, and the desired amount is dispensed by dispenser 146. For example, a recipe calls for certain amount of water (e.g., ⅓ cup, ½ cup, 1 tablespoon, 2 teaspoons, 6 ounces, etc.), and instead of using a measuring cup, the user can use any size container (large enough to hold the desired amount) by entering the desired amount using interface 148, and receiving the desired amount via dispenser 146. Dispenser 146 also dispenses ice cubes. A user may control a size of the ice cubes. In one embodiment, by selecting a smaller size ice cube, the ice cubes may be formed more quickly.

Figure 4:
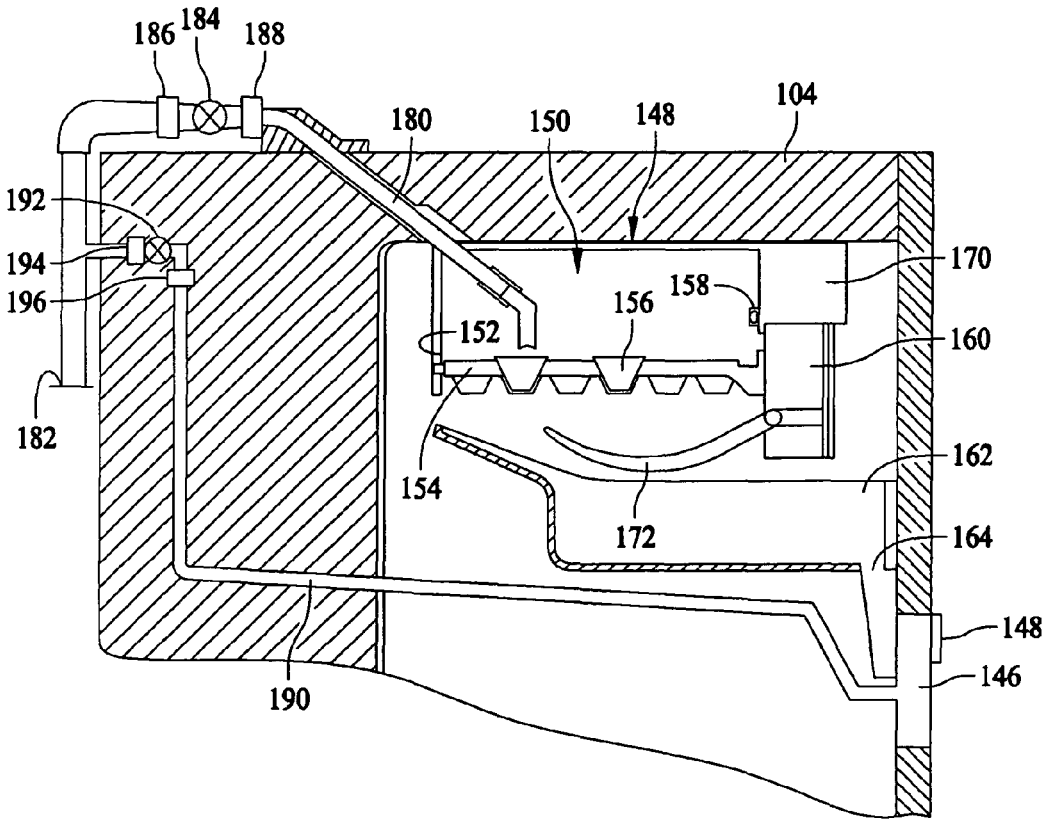
FIG. 4 is a cross sectional view of an exemplary ice maker using the water dispenser assembly.

FIG. 4 is a partial cross-sectional view of ice maker 150 including a water dispenser assembly. Ice maker 150 includes a metal mold 152 with a bottom wall 154 in which a plurality of cavities are defined to form ice pieces 156 when water flows successively to each cavity. In the exemplary embodiment, a water level detector 158 is mounted on an inner sidewall of ice maker 150 at a predetermined height to indicate the filled water level. To remove ice pieces 156 formed in the cavities in metal mold 152, bottom wall 154 is rotatably connected to a motor assembly 160 that reverses together with bottom wall 154 to get ice pieces 156 removed from cavities to a storage bucket 162 when ice pieces 156 are formed. Storage bucket 162 is located below ice maker 150. An outlet opening 164 is defined through the bottom of storage bucket 162 and is in communication with chute 146 through fresh food door 134 when fresh food door 134 is in a closed position.

Operation of motor assembly 160 and ice maker 150 are effected by a controller 170 operatively coupled to motor assembly 160 and ice maker 150. Controller 170 operates ice maker 150 to refill mold 152 with water for ice formation after ice is harvested. In order to sense the level of ice pieces 156 in storage bin 168, a sensor arm 172 is operatively coupled to controller 170 for controlling an automatic ice harvest so as to maintain a selected level of ice in storage bucket 162. Sensor arm 172 is rotatably mounted at a predetermined position on motor assembly 160 to sense a level of ice pieces 156 into which ice pieces 156 are harvested and delivered from metal mold 152. Sensor arm 172 is automatically raised and lowered during operation of ice maker 150 as ice is formed. Sensor arm 172 is spring biased to a lower position that is used to determine initiation of a harvest cycle and raised by a mechanism (not shown) as ice is harvested to clear ice entry into storage bucket 162 and to prevent accumulation of ice above sensor arm 172 so that sensor arm 172 does not move ice out of storage bucket 162 as sensor arm 172 raises. When ice obstructs sensor arm 172 from reaching its lower position, controller 170 discontinues harvesting because storage bucket 162 is sufficiently full. As ice is removed from storage bucket 162, sensor arm 172 gradually moves to its lower position, thereby indicating a need for more ice and causing controller 170 to initiate a fill operation as described in more detail below.

To supply water to ice maker 150 for making ice, first water dispenser 180 is in communication with a water source 182 and ice maker 150. A first water valve 184 is coupled to first water dispenser 180 and is also operatively coupled to controller 170. A sensor 186, such as, for example, a flow meter, is used to detect a volume of water flowing through water dispenser 180 into ice maker 150. In the exemplary embodiment, flow meter 186 is an axial flow meter, wherein water flows through flow meter 186 along an axis of rotation of the blades of flow meter 186. Alternatively, flow meter 186 is a radial flow meter, wherein water flows through flow meter 186 generally perpendicular to an axis of rotation of the blades of flow meter 186. In other alternative embodiments, flow meter 186 is a turbine rate meter, a thermal mass sensor, a pressure differential sensor, a flow washer, an electromagnetic sensor, an ultrasonic sensor, or the like. Flow meter 186 may be coupled to one of water source 182, water valve 184, or the outlet into ice maker 150. Flow meter 186 is configured to measure the amount of water passing through flow meter 186. Flow meter 186 is also operatively coupled to controller 170 which is configured to receive a signal indicating the quantity of water passing though flow meter 186. A second sensor 188, such as, for example, a pressure sensor, is also used to measure the pressure of the water flowing past flow meter 186. Pressure sensor 188 may be positioned immediately upstream of, immediately downstream of, or remote with respect to flow meter 186 for detecting the pressure of the water.

In the exemplary embodiment, a second water dispenser 190 is in communication with water source 182 and dispenser 146. A second water valve 192 is coupled to second water dispenser 190 and is operatively coupled to controller 170. Second water valve 192 controls the flow of water through second water dispenser 190. A sensor 194, such as, for example, a flow meter, is configured to measure the amount of water flowing through second water dispenser 190. In the exemplary embodiment, flow meter 194 is an axial flow meter, wherein water flows through flow meter 194 along an axis of rotation of the blades of flow meter 194. Flow meter 194 is also operatively coupled to controller 170 which is configured to receive a signal indicating the quantity of water passing though flow meter 194. Controller 170 may operate valve 192 based upon the signal from flow meter 194. Flow meter 194 may be coupled to one of water source 182, water valve 184, or the outlet at dispenser 146. As such, in one embodiment, a single flow meter 186 or 194 may be used to measure the amount of water channeled to both first and second water dispensers 180 and 190, such as, for example, by coupling flow meter 186 proximate water source 182. Alternatively, multiple flow meters 186 and 194 are used to independently measure the flow through first and second water dispensers 180 and 190, respectively. A second sensor 196, such as, for example, a pressure sensor, is also used to measure the pressure of the water flowing past flow meter 194. Pressure sensor 196 may be positioned immediately upstream of, immediately downstream of, or remote with respect to flow meter 194 for detecting the pressure of the water.

Figure 5:
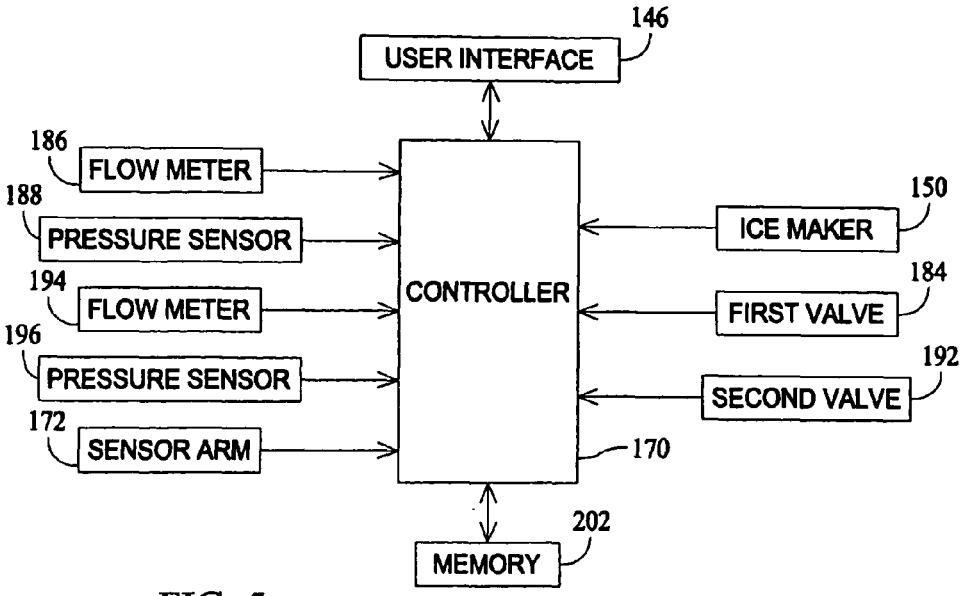
FIG. 5 is a schematic view of a control system for use with the appliance shown in FIG. 1.

FIG. 5 is a control system 200 for use with refrigerator 100 shown in FIG. 2. Controller 170 is operatively coupled to flow meters 186 and 194, pressure sensors 188 and 196, user interface 148, water level detector 158, sensor arm 172, first water valve 184, second water valve 192, and a memory element 202. Controller 170 is programmed to operate the above mentioned components. In the exemplary embodiment, controller 170 can be implemented as a microprocessor. The term microprocessor as used hereinafter is not limited just to microprocessors, but broadly refers to computers, processors, microcontrollers, microcomputers, programmable logic controllers, application specific integrated circuits, and other programmable logic circuits, and these terms are used interchangeably herein.

In the exemplary embodiment, each flow meter 186 and 194 includes a rotating element (not shown), a magnet (not shown) mounted to the rotating element, and a circuit with a reed switch (not labeled) placed relative to the rotating element such that every time a magnet passes close to the reed switch, a circuit is completed and a pulse is generated. A programmable logic controller (PLC) with a high speed counter (not labeled) is utilized with the reed switch such that an exact amount of water passing through flow meter 186 can be calculated.

In use, water can be dispensed into ice maker 150 in different modes. In a first mode, a user can select a predetermined amount of water dispensed into ice maker 150. Specifically, the user enters a desired amount of water or a desired ice cube size using user interface 148. Controller 170 then initiates a water fill into ice maker 150 from water source 182, through flow meter 186 and first water valve 184. As flow meter 186 senses that the quantity of water reaches the preselected amount, a signal is sent to controller 170. Controller 170 then sends a signal to first water valve 184 to close. As such, no more water is supplied to ice maker 150. Afterwards, a predetermined size of ice cubes will be made, since the size of ice pieces or ice cubes depends on the amount of water supplied into metal mold 152 of ice maker 150. As a result, under-filling or over-filling of the ice maker will be avoided. In addition, the user can obtain the desired size of ice pieces.

In a second mode, the user may select a continuous fill, wherein controller 170 will command water valve 184 to open, thereby allowing water to flow into ice maker 150 continuously until water level detector 158 informs controller 170 that the water level in ice maker 150 has reached an upper limit. Then, controller 170 will instruct water valve 184 to close to prevent any water from being supplied.

In another exemplary embodiment, a desired amount of water can be discharged from dispenser 146 by second water dispenser 190. For example, a recipe calls for a certain amount of water (e.g., a teaspoon, a table teaspoon, ¼ cup, ⅓ cup, ½ cup, 1 cup, 2 cups, etc.), and instead of using a measuring cup, the user can use any size container (large enough to hold the desired amount) by entering the desired amount using user interface 148. Then, controller 170 opens second water valve 192, allowing water to flow into the user's container. In a second mode, the user may desire a continuous flow of water to dispenser 146. Controller 170 leaves valve 192 open until the user stops demanding water.

Figure 6:
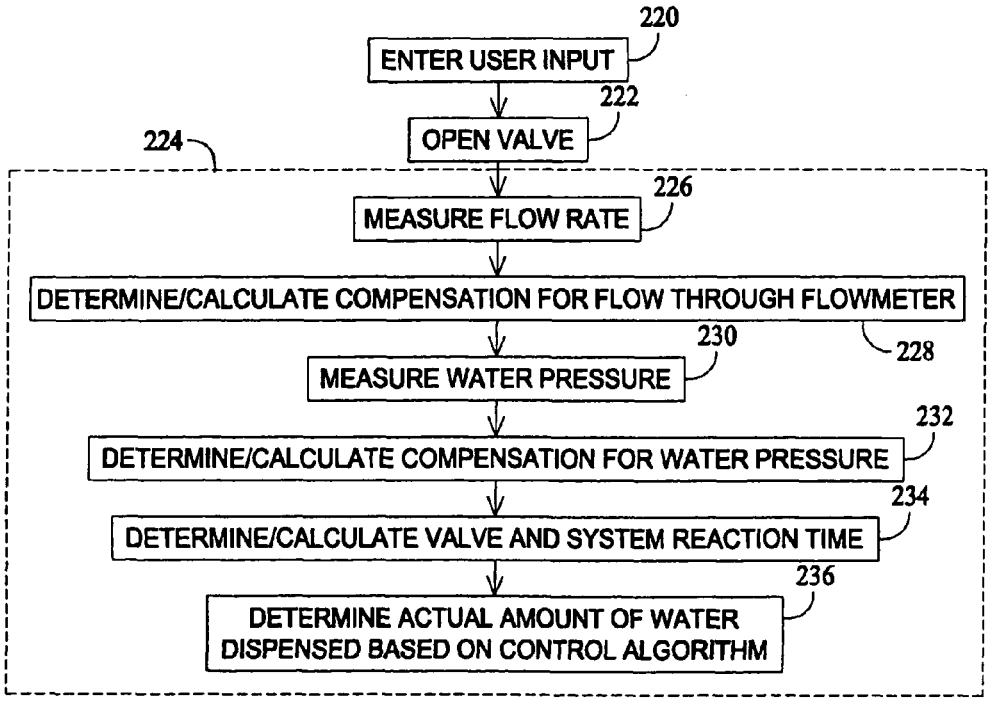
FIG. 6 is a flow diagram showing an exemplary control method for the water dispenser assembly shown in FIG. 1.

FIG. 6 is a flow diagram showing an exemplary control method for water dispenser assembly 12 (shown in FIG. 1). A user input is entered 220 at user interface 148 (shown in FIG. 3). For example, a user selects a desired amount of water, a fill level, or a desired ice cube size via a keypad or tactile button. Alternatively, a user may depress a dispensing paddle to demand water or ice. A signal relating to the user input is sent to controller 170 (shown in FIGS. 4 and 5). Controller 170 then operates the various components of appliance 10 based on the user input entered 220. For example, controller opens 222 valve 20 or 22, and in the particular embodiment of refrigerator 100, controller opens 22 valve 184 or 192. When valve 184 or 192 is opened, water flows through first or second water dispensers 180 or 190, respectively.

The volume of water flowing through water dispenser 180 or 190 is measured or calculated 224. For example, flow meter 186 or 194, respectively, may be utilized to measure 226 a flowrate of water flowing through water dispenser 180 or 190. Once the flowrate is measured, a compensation value for the flowrate through flow meter 186 or 194 is determined or calculated 228. The compensation value may be determined based on a formula or the compensation value may be determined based on a look-up table. Additionally, in one embodiment, a pressure of the water flowing through water dispenser 180 or 190, such as, for example, at an inlet, is measured 230. For example, pressure sensor 188 or 196, respectively, may be utilized to measure the pressure of water flowing through water dispenser 180 or 190 past flow meter 186 or 194. Once the pressure of the water is measured 230, a compensation value for the water pressure is determined or calculated 232. The compensation value may be determined based on a formula or the compensation value may be determined based on a look-up table. In one embodiment, a valve or system reaction time is determined or calculated 234.

Once the various values are measured or calculated, the actual or adjusted amount of water dispensed is determined or calculated 236 based on a control algorithm. In one embodiment, the control algorithm uses the measured 226 flowrate, the measured pressure 230, error factor compensation values, such as the compensation values determined at 228 and 232, and the valve or system reaction time value determined at 234 to adjust the measured volume to an adjusted volume. Controller 170 operates valve 184 or 192 based on the adjusted volume. In one embodiment, the error factor is based on the measured pressure of the water. For example, flow meter 186 or 194 may measure different or inaccurate volumes based on the pressure of the water. For example, higher pressures of water may lead to an underestimate in the volume of water dispensed. Alternatively, lower pressures of water may lead to an overestimate in the volume of water dispensed. Additionally, the pressure of water may change during filling based on other water demands within water dispenser assembly 12, or external to water dispenser assembly 12. Use of the error factor correction provides a more accurate measure of the amount of water dispensed from first or second water dispensers 180 or 190.

Figure 7:
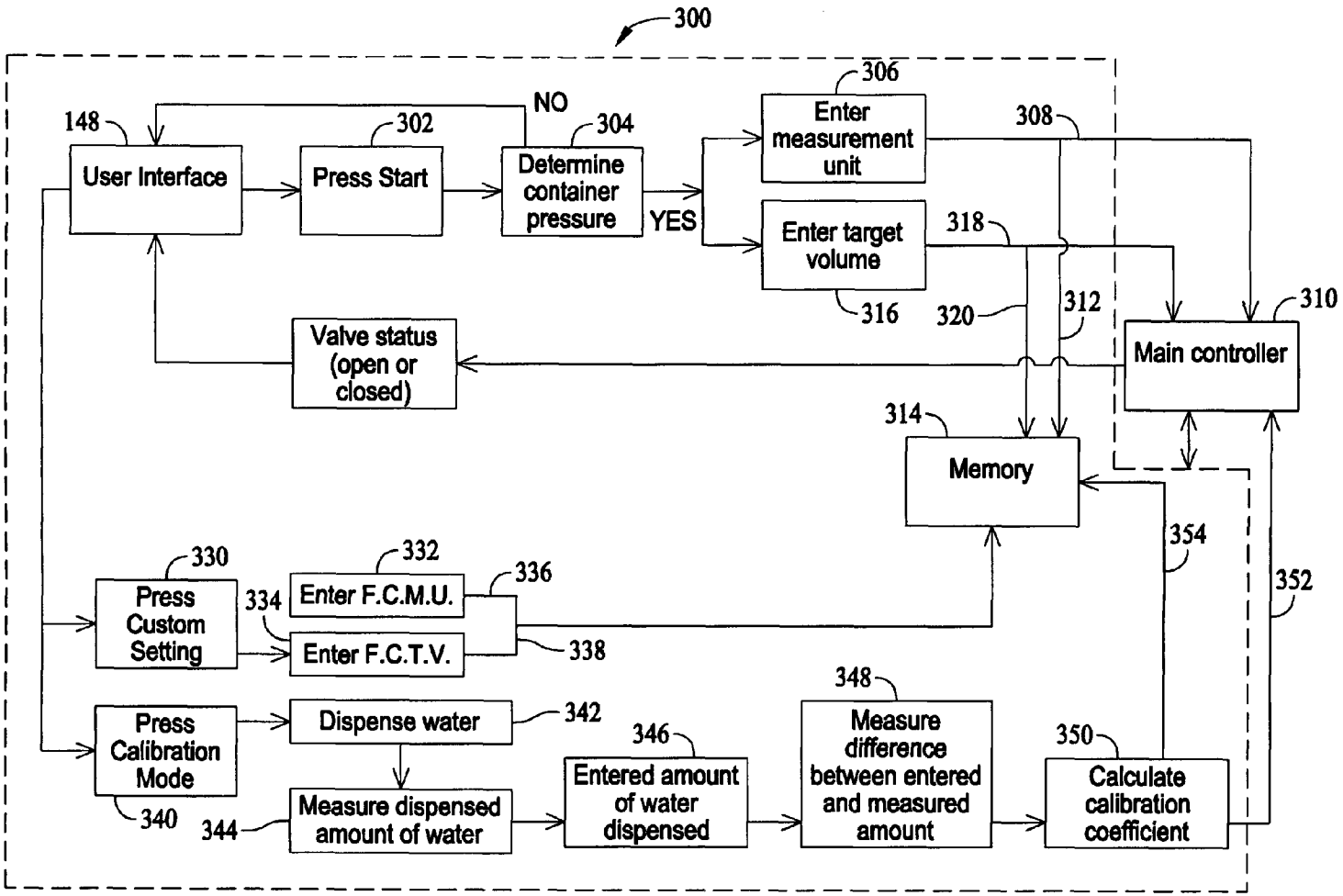
FIG. 7 is a flow diagram showing another exemplary control method for the water dispenser assembly shown in FIG. 1.
Figure 8:
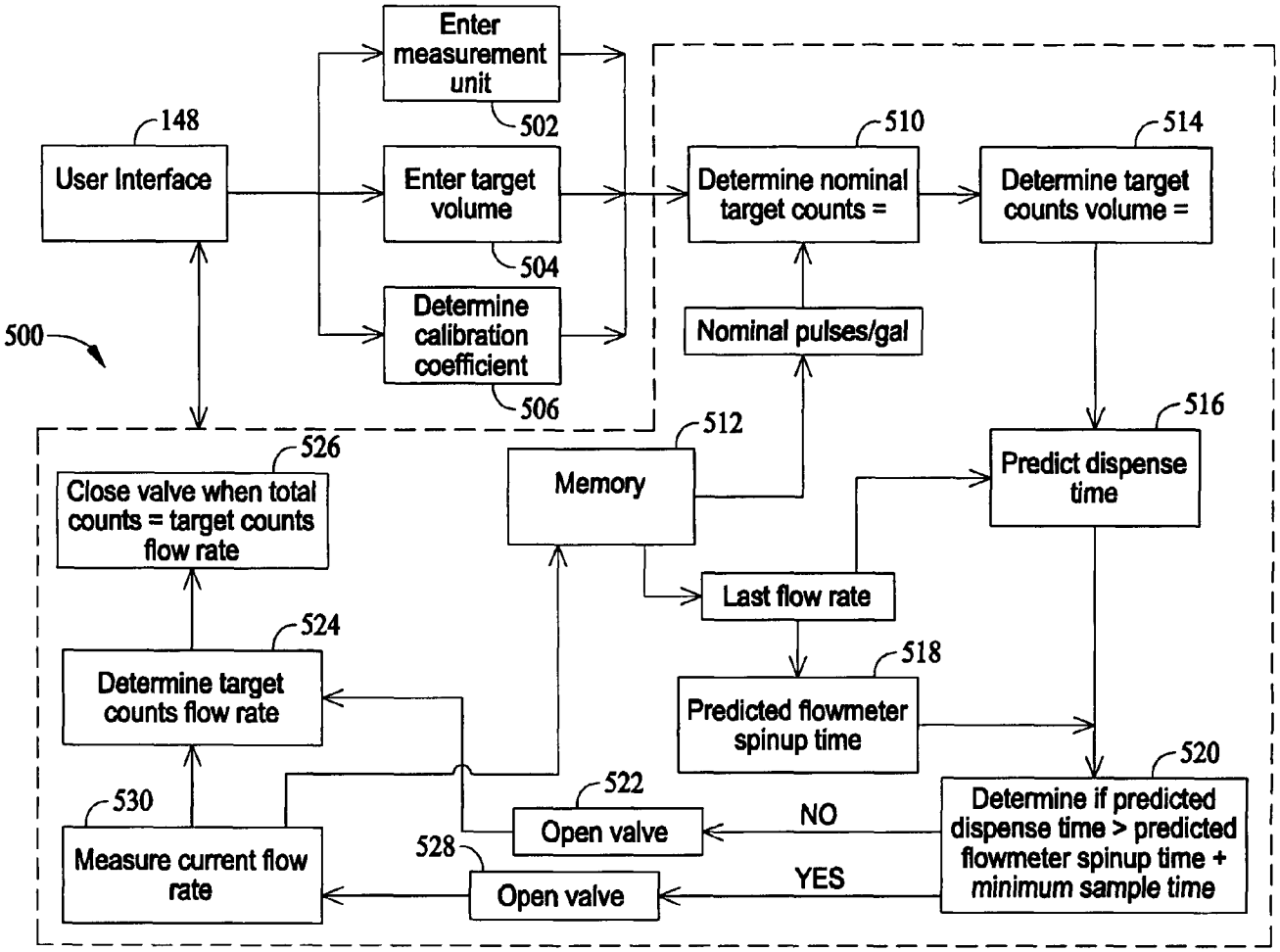
FIG. 8 is a flow diagram showing yet another exemplary control method for the water dispenser assembly shown in FIG. 1.
Figure 9:
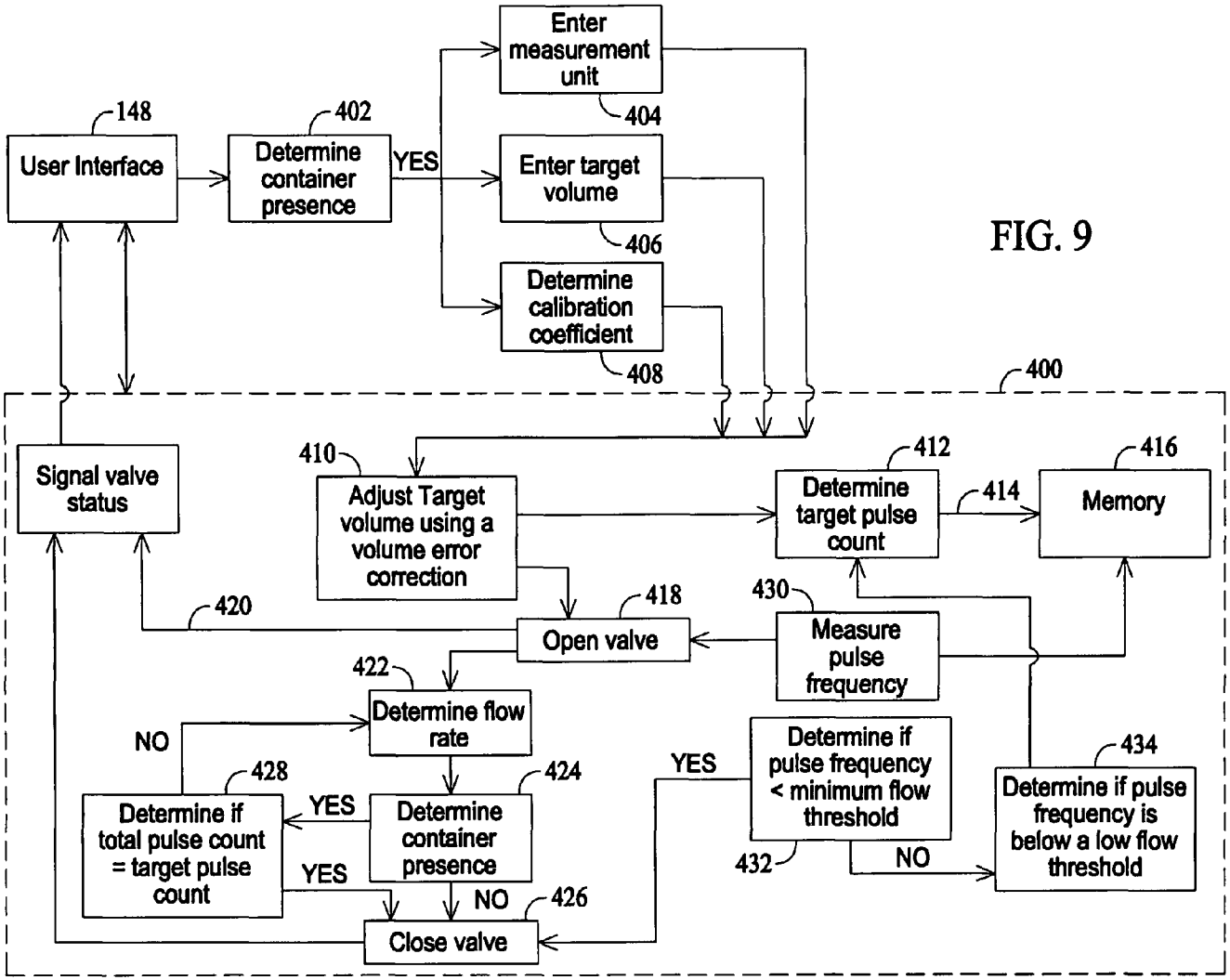
FIG. 9 is a flow diagram showing a further exemplary control method for the water dispenser assembly shown in FIG. 1.

FIGS. 7-9 are flow diagrams showing exemplary control methods for water dispenser assembly 12 (shown in FIG. 1). The methods use flow meter 186 or 194 to determine the volume of water flowing through valve 20 or 22, and thus outlet 16 or 18 (shown in FIG. 1). Flow meters 186 or 194 are typically designed for a finite range of operating conditions. Since the range of operating conditions in a user's home, and thus appliance 10, may be very broad, environmental factors can cause flow meter 186 or 194 to yield inaccurate and erroneous results. For example, the accuracy of flow meter 186 or 194 may be affected by ambient noise parameters such as water pressure, temperature, consumer use patterns, age or deterioration of flow meter 186 or 194, and the like. Variations in operating conditions are compensated for using software in controller 170, and methods of operating described below. The software in controller 170 includes programs embodied on a computer readable medium having code segments configured to perform at least the method steps described below. The methods involve measuring the relevant environmental conditions and using correction values to correct the signals from the flow meter 186 or 194.

Turning specifically to FIG. 7, a flow diagram illustrating a control method for a human machine interface (HMI) controller 300 is provided. Controller 300 is similar to controller 170 (shown in FIG. 4) and is used to receive inputs from, and send outputs to, a HMI, such as user interface 148, located proximate dispenser 146 (shown in FIG. 3). Controller 300 is operable in multiple modes of operation.

In a dispensing mode of operation, a user presses 302 a Start button at user interface 148. Controller 300 determines 304 if a container is present proximate dispenser 146 using optical sensor 149. If no container is present, no water is dispensed and a signal is sent to user interface 148 indicating to the user that a container is not present. For example, a message is displayed to the user at the display of user interface 148. If a container is present, the user enters 306 a measurement unit at user interface 148 and a corresponding signal is received at controller 300. For example, a user may enter a measurement unit such as a cup, an ounce, a tablespoon, a teaspoon, a liter, a milliliter, a gallon, and the like. Alternatively, a user may enter a non-measuring measurement unit, such as, for example, a glass filing unit. An input relating to the measurement unit is also sent 308 to a main controller 310 for appliance 10. An input relating to the measurement unit is sent 312 to a memory 314 of controller 300 and is saved in memory 314 as Measurement Unit Last. The Measurement Unit Last is used as the default measurement unit the next time dispenser 146 is used. Alternatively, one measurement unit, such as a cup is always used as the default measurement unit when dispenser 146 is used.

Next, the user enters 316 a desired or target volume to be dispensed and a corresponding signal is received at controller 300. For example, a user may enter 1 cup, ½ cup, 1 tablespoon, 2 teaspoons, 6 ounces, and the like. In the situation in which the user selects the non-measuring measurement unit, the volume corresponds to different sizes of glasses such as small, medium and large, each of which have a predetermined corresponding volume of water to dispense. For example, a small size dispenses 1 cup, a medium size dispenses 2 cups, and a large size dispenses 4 cups. An input relating to the target volume is sent 318 to main controller 310 for appliance 10. An input relating to the target volume is sent 320 to memory 314 of controller 300 and is saved in memory 314 as Target Volume Last. The Target Volume Last is used as the default target volume the next time dispenser 146 is used. Alternatively, one target volume, such as one is always used as the default target volume when dispenser 146 is used.

In a custom setting mode of operation, the user presses 330 a Custom Setting button at user interface 148. The user then enters 332 a first custom measurement unit and enters 334 a first custom target volume. An input relating to the custom measurement unit is sent 336 to memory 314 of controller 300 and is saved in memory 314 as Custom1 Measurement Unit. An input relating to the target volume is sent 338 to memory 314 of controller 300 and is saved in memory 314 as Custom1 Target Volume. The Custom1 Measurement Unit and the Custom1 Target Volume define a first custom setting. Optionally, the user may generate a second custom setting in the same manner. Memory 314 is configured to store multiple custom settings. The custom settings can be deleted from memory at user interface 148.

In a calibration mode of operation, the user presses 340 a Calibration button at user interface 148. The user then manually dispenses 342 a measurable amount of water, such as into a measuring cup. Flow meter 186 or 194 measures 344 the amount of water dispensed. For example, flow meter 186 or 194 measures a number of pulses corresponding to the amount of water dispensed. A signal relating to the measured amount of water measured by flow meter 186 or 194 is received by controller 246. The user manually enters 346 the amount of water actually dispensed at user interface 148, as a function of a measurement unit and a volume. Controller 300 then measures 348 a difference between the amount of water entered 346 by the user and the amount of water measured by flow meter 186 or 194. Controller 300 uses the difference to calculate 350 a calibration coefficient. The calibration coefficient is thus based on the flow rate of water measured by flow meter 186 or 194. The calibration coefficient is used to adjust the total volume of water dispensed to compensate for inaccuracies of flow meter 186 or 194 arising from ambient noise parameters such as water pressure, temperature, consumer use patterns, age or deterioration of flow meter 186 or 194, and the like. An input relating to the calibration coefficient is sent 352 to main controller 310 for appliance 10. An input relating to the calibration coefficient is sent 354 to memory 314 of controller 300 and is saved in memory 314.

In the exemplary embodiment, main controller 310 sends a signal to user interface 148 relating to an operating status of valve 20 or 22. For example, the signal indicates if valve 20 or 22 is open or closed. User interface 148 displays the status of valve 20 or 22 at the display of user interface 148.

Turning specifically to FIG. 8, a flow diagram illustrating a control method for a controller 400 is provided. Controller 400 is similar to controller 170 (shown in FIG. 4) and is used to control valve 20 or 22 (shown in FIG. 1) for appliance 10 (shown in FIG. 1). Controller 400 communicates with user interface 148 (shown in FIG. 3) and flow meter 186 or 194 (shown in FIG. 4).

In operation, controller 400 determines 402 if a container is present proximate dispenser 146 (shown in FIG. 3) using optical sensor 149 (shown in FIG. 3). If no container is present, no water is dispensed and a signal is sent to user interface 148 indicating to the user that a container is not present. For example, a message is displayed to the user at the display of user interface 148. If a container is present, the user enters 404 a measurement unit at user interface 148 and a corresponding signal is received at controller 400. Next, the user enters 406 a desired or target volume to be dispensed and a corresponding signal is received at controller 400. In the exemplary embodiment, controller 400 is optionally configured to determine 408 a calibration coefficient to adjust the actual volume dispensed by dispenser 146. The calibration coefficient is determined in a similar manner as described with reference to FIG. 7. The calibration coefficient is based on the flow rate of water measured by flow meter 186 or 194. The calibration coefficient is used to adjust the total volume of water dispensed to compensate for inaccuracies of flow meter 186 or 194 arising from ambient noise parameters such as water pressure, temperature, consumer use patterns, age or deterioration of flow meter 186 or 194, and the like.

Next, controller 400 adjusts 410 the target volume input by the user at user interface 148 using a volume error correction to obtain an adjusted target volume. The volume error correction is based on the flow rate of dispenser 146. In the exemplary embodiment, controller 400 determines 412 a target pulse count based on the measurement unit and the target volume. The target pulse count is a target amount of pulses to be measured by flow meter 186 or 194 when valve 20 or 22 is opened. In the exemplary embodiment, the target pulse count is adjusted by an error correction to obtain an adjusted target pulse count. In an alternative embodiment, controller 400 determines 412 the target pulse count based on the adjusted target volume, thus obtaining the adjusted target pulse count. An input relating to the adjusted target pulse count is sent 414 to a memory 416 of controller 400.

Once the adjusted target volume is obtained, controller 400 opens 418 valve 20 or 22 to begin the flow of water through dispenser 146. A signal relating to valve 20 or 22 being open is sent 420 to user interface 148. As water flows through dispenser 146, flow meter 186 or 194 determines 422 a flow rate, such as by counting pulses. Controller 400 determines 424 if a container is present proximate dispenser 146. If no container is present, controller 400 closes 426 valve 20 or 22 and a signal is sent to user interface 148 indicating to the user that a container is not present. If a container is present, controller 400 determines 428 if the total pulse count is equal to the target pulse counts. If the total pulse count does not equal the target pulse count then the operation continues. If the total pulse count equals the target pulse count, then controller closes 426 valve 20 or 22 and a signal is sent to user interface 148 indicating to the user that valve 20 or 22 is closed.

Returning to step 418, once controller 400 opens 418 valve 20 or 22, controller 400 measures 430 a pulse frequency of flow meter 186 or 194 and an input relating to the measured frequency is sent to memory 416. Controller 400 then determines 432 if the pulse frequency is below a minimum flow threshold, such as 1 Hertz. If the pulse frequency is below the minimum flow threshold but water is being dispensed, then flow meter 186 or 194 is not functioning properly. Controller 400 closes 426 valve 20 or 22 and a signal is sent to user interface 148 indicating to the user that flow meter 186 or 194 is not functioning properly. As such, controller 400 does not allow overflowing of the container when no pulses are being received by flow meter 186 or 194. However, if the pulse frequency is above the minimum flow threshold, controller 400 will determine 434 if the pulse frequency is below a low flow threshold, wherein flow meter 186 or 194 is operating in a low flow mode of operation. In the low flow mode of operation, flow meter 186 or 194 has not yet completely overcome friction forces, and the pulse count is lower than an expected pulse count. As such, flow meter 186 or 194 is inaccurately measuring the flow rate. Once the friction force is overcome, flow meter 186 or 194 is operating in a normal mode of operation and is accurately measuring the flow rate. As such, an error correction is needed to correct the total volume measurement during the time period when flow meter 186 or 194 is operating in the low flow mode of operation. At step 434, if the pulse frequency is below the low flow threshold, controller 400 corrects or adjusts the target count to accommodate for the inaccurate measurements of flow meter 186 or 194.

Turning specifically to FIG. 9, a flow diagram illustrating a control method for a controller 500 is provided. Controller 500 is similar to controller 170 (shown in FIG. 4) and is used to control valve 20 or 22 (shown in FIG. 1) for appliance 10 (shown in FIG. 1). Controller 500 communicates with user interface 148 (shown in FIG. 3) and flow meter 186 or 194 (shown in FIG. 4).

In operation, the user enters 502 a measurement unit at user interface 148 and a corresponding signal is received at controller 500. Next, the user enters 504 a desired or target volume to be dispensed and a corresponding signal is received at controller 500. In the exemplary embodiment, controller 500 is optionally configured to determine 506 a calibration coefficient to adjust the actual volume dispensed by dispenser 146. The calibration coefficient is determined in a similar manner as described with reference to FIG. 7. The calibration coefficient is based on the flow rate of water measured by flow meter 186 or 194. The calibration coefficient is used adjust the total volume of water dispensed to compensate for inaccuracies of flow meter 186 or 194 arising from ambient noise parameters such as water pressure, temperature, consumer use patterns, age or deterioration of flow meter 186 or 194, and the like.

Next, controller 500 determines 510 a Nominal Target Counts. The Nominal Target Counts is determined as a function of, and is based upon, the measurement unit, the target volume, the calibration coefficient, if used, and a Nominal Pulses/Gallon variable. The Nominal Pulses/Gallon variable is based on the flow rate of flow meter 186 or 194 as stored in a memory 512 of controller 500. Once the Nominal Target Counts is determined 510, controller 500 determines 514 a Target Counts Volume. The Target Counts Volume is a function of, or is based on, the Nominal Target Count. Next, controller 500 predicts 516 a Dispense Time. The Dispense Time is a function of, or is based on, the Target Counts Volume and a Last Flow Rate. The Last Flow Rate is a value that is stored in, and updated in, memory 512. The Last Flow Rate is also used by controller 500 to predict 518 a Flowmeter Spin-up Time. The Flowmeter Spin-up Time is a function of, or is based on, the Last Flow Rate. The Flowmeter Spin-up Time is a time required for flow meter 186 or 194 to pass through the low flow operation and achieve the normal flow operation. The Flowmeter Spin-up Time is the time required for the turbine of flow meter 186 or 194 to overcome friction force.

Once the Dispense Time and the Flowmeter Spin-up Time are predicted, controller 500 compares the times and determines 520 if the Dispense Time is greater than the sum of the Flowmeter Spin-up Time and a Minimum Sample Time. The Minimum Sample Time is the time required to gather sufficient data from the measured pulse frequency of flow meter 186 or 194. If the Dispense Time is less than the sum of the Flowmeter Spin-up Time and a Minimum Sample Time, then controller 500 opens 522 valve 20 or 22 and determines 524 a Target Counts Flow Rate. The Target Counts Flow Rate is a function of, or is based on, the Target Counts Volume and the Last Flow Rate. Controller 500 then closes 526 valve 20 or 22 when the Total Counts equals the Target Counts Flow Rate. As such, when the dispense time is relatively short because a small volume is being dispensed, the total counts will be based on the preceding measured flow rate. However, at step 520, if the Dispense Time is greater than the sum of the Flowmeter Spin-up Time and a Minimum Sample Time, then controller 500 opens 528 valve 20 or 22 and measures 530 a flow rate to obtain a Current Flow Rate. The Current Flow Rate is stored in memory 512 and becomes Last Flow Rate for future calculations until replaced by another flow rate. After the Current Flow Rate replaces or overwrites the Last Flow Rate, controller determines 524 the Target Counts Flow Rate, and then closes 526 valve 20 or 22 when the Total Counts equals the Target Counts Flow Rate. As such, when the dispense time is long enough to measure a flow rate of the water because a large enough volume is being dispensed, the total counts will be based on the Current Flow Rate.

Refrigerator 100 provides a user selective modes of dispensing water into ice maker 150 such that the ice making process can be controlled by the user who sometimes desires to effectively control the size of the ice pieces or ice cubes. In addition, refrigerator 100 also provides the user with an option to dispense a predetermined amount of water in a cost effective and reliable manner. The methods and software described provide reliable and accurate measured dispensing by adjusting the total volume dispensed based on the flow rate of water through the system. As such, inaccuracies in measured volumes due to environmental conditions are overcome, and the actual amount of water dispensed is adjusted to provide a more accurate volume.

While the invention has been described in terms of various specific embodiments, those skilled in the art will recognize that the invention can be practiced with modification within the spirit and scope of the claims.

What is claimed is:

1. A refrigerator comprising:

a cooling system;

a dispenser coupled to said cooling system, said dispenser comprising a water valve for controlling a flow of water through said dispenser and a flowmeter for measuring the amount of water dispensed through said dispenser; and a controller operatively coupled to said water valve and said flowmeter, said controller configured to:

receive an input relating to a target volume of water;

adjust the target volume for a volume error correction to obtain an adjusted target volume, wherein the volume error correction is based on a flow rate;

open said water valve;

determine a total volume dispensed using said flowmeter; and close said water valve when the total volume dispensed equals the adjusted target volume.

2. A refrigerator in accordance with claim 1 wherein said controller is further configured to determine the total volume dispensed by counting pulses of said flowmeter to determine a total pulse count, and converting the total pulse count to a total volume.

3. A refrigerator in accordance with claim 1 wherein said controller is further configured to measure a pulse frequency of said flowmeter, wherein the volume error correction is based on the pulse frequency of said flowmeter.

4. A refrigerator in accordance with claim 1 wherein said controller is further configured to measure a pulse frequency of said flowmeter, wherein said flowmeter operates at one of a normal pulse frequency and a low pulse frequency, wherein the volume error correction is based on an amount of time said flowmeter operates at the low pulse frequency and the amount of time said flowmeter operates at the normal pulse frequency.

5. A refrigerator in accordance with claim 1 wherein said controller is further configured to:

measure a flow rate using said flowmeter;

store the flow rate in a memory; and predict a dispense time based on the stored flow rate and one of the target volume and the adjusted target volume.

6. A refrigerator in accordance with claim 1 wherein said controller is further configured to:

count pulses of said flowmeter to determine a current flow rate of water through said flowmeter;

predict a flowmeter spin-up time based on a preceding flow rate;

predict a dispense time based on the flow rate and one of the target volume and the adjusted target volume; and compare the dispense time to the spin-up time and a time required to measure a minimum pulse count of said flowmeter, wherein if the dispense time is greater than the sum of the spin-up time and a time required to measure a minimum pulse count of said flowmeter, then the volume error correction is based on the current flow rate, and wherein if the dispense time is less than the sum of the spin-up time and a time required to measure a minimum pulse count of said flowmeter, then the volume error correction is based on the preceding flow rate.

7. A method of controlling a water valve for a water dispensing system coupled to a cooling system of a refrigerator, the water dispensing system having a controller communicating with the water valve and a flowmeter, said method comprising:

receiving a target volume at the controller from a user interface;

adjusting the target volume for a volume error correction to obtain an adjusted target volume, wherein the volume error correction is based on a flow rate;

opening the water valve;

measuring the volume using the flowmeter to determine a total volume; and closing the water valve when the total volume equals the adjusted target volume.

8. A method in accordance with claim 7 wherein said measuring the volume using the flowmeter to determine a total volume further comprises:

counting pulses of the flowmeter to determine a total pulse count; and converting the total pulse count to a total volume.

9. A method in accordance with claim 7 further comprising measuring a pulse frequency of the flowmeter, wherein the volume error correction is based on the pulse frequency of the flowmeter.

10. A method in accordance with claim 7 further comprising measuring a pulse frequency of the flowmeter, wherein the flowmeter operates at one of a normal pulse frequency and a low pulse frequency, wherein the volume error correction is based on an amount of time the flowmeter operates at the low pulse frequency and the amount of time the flowmeter operates at the normal pulse frequency.

11. A method in accordance with claim 7 further comprising:

measuring a flow rate using the flowmeter;

storing the flow rate in a memory; and predicting a dispense time based on the stored flow rate and one of the target volume and the adjusted target volume.

12. A method in accordance with claim 7 further comprising:

counting pulses of the flowmeter to determine a current flow rate of water through the flowmeter;

predicting a flowmeter spin-up time based on a preceding flow rate;

predicting a dispense time based on the flow rate and one of the target volume and the adjusted target volume; and comparing the dispense time to the spin-up time and a time required to measure a minimum pulse count of the flowmeter, wherein if the dispense time is greater than the sum of the spin-up time and a time required to measure a minimum pulse count of the flowmeter, then the volume error correction is based on the current flow rate, and wherein if the dispense time is greater than the sum of the spin-up time and a time required to measure a minimum pulse count of the flowmeter, then the volume error correction is based on the preceding flow rate.

13. A method in accordance with claim 7 further comprising receiving a measurement unit at the controller from a user interface, and wherein said adjusting the target volume for a volume error correction to obtain an adjusted target volume further comprises adjusting the target volume for a volume error correction based on the measurement unit to obtain an adjusted target volume.

14. A method in accordance with claim 7 further comprising determining a calibration coefficient based upon a manual calibration of the water dispensing system, and wherein said adjusting the target volume for a volume error correction to obtain an adjusted target volume further comprises adjusting the target volume for a volume error correction based on the calibration coefficient to obtain an adjusted target volume.

15. A method in accordance with claim 7 further comprising:

detecting a presence of a container proximate to the water dispensing system; and closing the water valve when a container is no longer present proximate to the water dispensing system.

16. A computer program embodied on a computer readable medium for controlling a water valve for a water dispensing system coupled to a cooling system of a refrigerator, the water dispensing system having a controller communicating with the water valve and a flowmeter, said computer program comprising:

a code segment that receives an input relating to a target volume of water;

a code segment that adjusts the target volume for a volume error correction to obtain an adjusted target volume, wherein the volume error correction is based on a flow rate;

a code segment that opens the water valve;

a code segment that determines a total volume dispensed using inputs from the flowmeter; and a code segment that closes the water valve when the total volume dispensed equals the adjusted target volume.

17. A computer program in accordance with claim 16 further comprising a code segment that measures a pulse frequency of the flowmeter, wherein the volume error correction is based on the pulse frequency of the flowmeter.

18. A computer program in accordance with claim 16 further comprising a code segment that measures a pulse frequency of the flowmeter, wherein the flowmeter operates at one of a normal pulse frequency and a low pulse frequency, wherein the volume error correction is based on an amount of time the flowmeter operates at the low pulse frequency and the amount of time the flowmeter operates at the normal pulse frequency.

19. A computer program in accordance with claim 16 further comprising:

a code segment that measures a flow rate using the flowmeter;

a code segment that stores the flow rate in a memory; and a code segment that predicts a dispense time based on the stored flow rate and one of the target volume and the adjusted target volume.

20. A computer program in accordance with claim 16 further comprising:

a code segment that counts pulses of the flowmeter to determine a current flow rate of water through the flowmeter;

a code segment that predicts a flowmeter spin-up time based on a preceding flow rate;

a code segment that predicts a dispense time based on the flow rate and one of the target volume and the adjusted target volume; and a code segment that compares the dispense time to the spin-up time and a time required to measure a minimum pulse count of said flowmeter, wherein if the dispense time is greater than the sum of the spin-up time and a time required to measure a minimum pulse count of the flowmeter, then the volume error correction is based on the current flow rate, and wherein if the dispense time is less than the sum of the spin-up time and a time required to measure a minimum pulse count of the flowmeter, then the volume error correction is based on the preceding flow rate.

* * * * *